US005868176A

United States Patent [19]

Barajas et al.

[11] Patent Number: 5,868,176

[45] Date of Patent: Feb. 9, 1999

[54] SYSTEM FOR CONTROLLING THE FILL OF COMPRESSED NATURAL GAS CYLINDERS

[75] Inventors: André M. Barajas, San Antonio; John C. Buckingham, Boerne; Steven Svedeman, San Antonio, all of Tex.

[73] Assignee: Gas Research Institute, Chicago, Ill.

[21] Appl. No.: 863,970

[22] Filed: May 27, 1997

[51] Int. Cl.[6] ..... B65B 1/04; B65B 3/04

[52] U.S. Cl. ..... 141/83; 141/95; 141/198

[58] Field of Search ..... 141/4, 18, 21, 141/83, 198, 94–96, 39, 47, 100, 102, 104; 137/552, 554

[56] References Cited

U.S. PATENT DOCUMENTS

| | | | |
|---|---|---|---|
| 4,010,623 | 3/1977 | Kaschak | 62/55 |
| 4,419,898 | 12/1983 | Zanker et al. | 73/861.02 |
| 4,527,600 | 7/1985 | Fisher et al. | 141/4 |
| 4,865,088 | 9/1989 | Stearns | 141/5 |
| 4,883,099 | 11/1989 | Vanommeren | 141/1 |
| 4,898,217 | 2/1990 | Corbo et al. | 141/83 |
| 4,966,206 | 10/1990 | Baumann et al. | 141/98 |
| 4,987,932 | 1/1991 | Pierson | 141/1 |
| 5,029,622 | 7/1991 | Mutter | 141/4 |
| 5,211,021 | 5/1993 | Pierson | 62/50.2 |
| 5,259,424 | 11/1993 | Miller et al. | 141/4 |
| 5,351,726 | 10/1994 | Diggins | 141/4 |
| 5,365,981 | 11/1994 | Peschka et al. | 141/7 |
| 5,373,702 | 12/1994 | Kalet et al. | 62/50.2 |
| 5,385,176 | 1/1995 | Price | 141/1 |
| 5,406,988 | 4/1995 | Hopkins | 141/2 |
| 5,409,046 | 4/1995 | Swenson et al. | 141/11 |
| 5,411,374 | 5/1995 | Gram | 417/53 |
| 5,431,203 | 7/1995 | Schultz et al. | 141/197 |
| 5,465,583 | 11/1995 | Goode | 62/50.2 |
| 5,628,349 | 5/1997 | Diggins et al. | 141/3 |
| 5,771,948 | 6/1998 | Kountz et al. | 141/83 |

*Primary Examiner*—Steven O. Douglas
*Attorney, Agent, or Firm*—Thomas, Kayden, Horstemeyer & Risley, L.L.P.

[57] ABSTRACT

A system for controlling the fill of a receptacle cylinder with compressed natural gas (CNG). The flow of gas into the receptacle cylinder is controlled by a fill controller with software configured to calculate the mass of gas to be added to the cylinder as a function of the pressure and temperature in the cylinder during the fill process and to open and close a flow valve in accordance with such calculation.

7 Claims, 4 Drawing Sheets

SYSTEM FOR CONTROLLING THE FILL OF COMPRESSED NATURAL GAS CYLINDERS

FIELD OF THE INVENTION

The present invention generally relates to the field of temperature measurement, and more particularly, to a system and method for accurately measuring the mass of compressed natural gas (CNG) in a receptacle cylinder being filled during a fast fill process, and for controlling the fill process to account for the effects on such mass caused by variations of temperature and pressure in the cylinder.

BACKGROUND OF THE INVENTION

In a compressed natural gas (CNG) fast fill process, the mass of gas contained in a receptacle cylinder is dependent on the temperature and pressure in the cylinder. It is therefore necessary for the fill system to account for variations in pressure and temperature in order to ensure that the fill process does not overfill or underfill the cylinder.

The most typical fill control system now used is an ambient temperature compensation system. In an ambient temperature compensation system, the fill control system attempts to fill the cylinder to a condition where the density of the gas in the cylinder is equal to the density of the gas at the rated cylinder pressure and the ambient temperature. However, during the fast fill process, the gas in the cylinder is compressed at a rapid rate. During this compression process, there is little time for a significant amount of heat transfer to occur, thus the gas temperature in the cylinder increases rapidly. As the fill is completed, the gas begins to cool and the pressure in the cylinder begins to decrease. As the temperature of the gas approaches equilibrium with the ambient temperature, the gas pressure in the cylinder decreases below the rated cylinder pressure. Thus, an ambient temperature compensation system results in underfilling of the cylinder because such system fails to account for the heat of compression in the cylinder arising from the fill process.

Current systems for dispensing CNG that do not use an ambient temperature compensation system likewise do not have the capability of determining and accurately compensating for the heat of compression generated in the receptacle cylinder. An example of a current dispensing system is illustrated in U.S. Pat. No. 4,527,600 to Fisher et al. In such system, the pressure and temperature at the dispenser are measured, which allows for an accurate measurement of the volume of CNG dispensed. However, like an ambient temperature compensation system, the system described in Fisher fails to account for the temperature rise in the receptacle cylinder due to the heat of compression generated during the fill process and, thus, also results in underfilling of the cylinder.

Because current systems for dispensing CNG do not have the capability of directly measuring and compensating for the temperature rise in the receptacle cylinder caused by the heat of compression inherent in the filling process, a heretofore unaddressed need exists in the industry for a system for accurately controlling the fill of CNG cylinders by monitoring and compensating for the temperature rise in the receptacle cylinder that occurs during the fill process.

SUMMARY OF THE INVENTION

The fill control system of the present invention allows a compressed natural gas (CNG) dispenser to overcome the difficulties of current fill control systems. The present invention monitors the gas temperature in the receptacle cylinder during the fill process and compensates for the heat of compression that is inherently created in the cylinder when CNG is dispensed in a fast fill manner. This allows the receptacle cylinder to be filled closer to its maximum capacity without being overfilled.

BRIEF DESCRIPTION OF THE DRAWINGS

The present invention can be better understood with reference to the following drawings. The drawings are not necessarily to scale, emphasis instead being placed upon clearly illustrating principles of the present invention. Furthermore, in the figures, like reference numerals designate corresponding parts throughout the several views.

DETAILED DESCRIPTION OF THE PREFERRED EMBODIMENT

Figure 1:
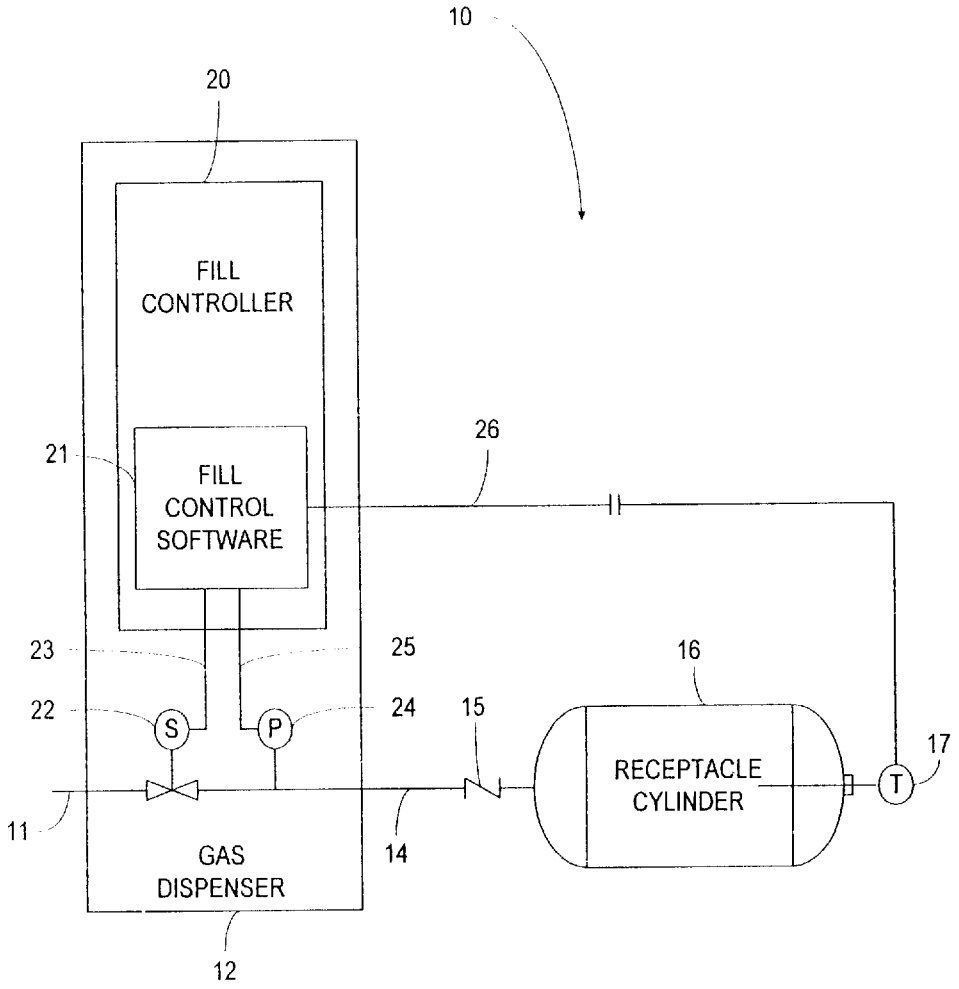
FIG. 1 is a schematic representation of a fill control system method in accordance with the present invention.

With reference now to the drawings, FIGS. 1 and 2A–2C illustrate a first embodiment of a fill control system and method generally denoted by reference numeral 10 in accordance with the present invention.

FIG. 1 illustrates the basic system configuration as follows: a compressed natural gas (CNG) dispenser 14 is connected on its input side to a supply of CNG made up of three cascade banks 11, 12 and 13. The output of the dispenser 15 is connected by a conventional flexible dispensing hose 16 to a receptacle cylinder 18. The cylinder is equipped with a conventional one-way check valve 17 which prevents the escape of gas from the cylinder when hose 16 is not connected to the cylinder.

A fill controller 20 located within the dispenser 14 controls the flow of gas to the cylinder 18 by means of three solenoid valves 21, 22 and 23. The first solenoid valve 21 is connected on its input side to the first CNG cascade bank 11. The second solenoid valve 22 is connected on its input side to the second CNG cascade bank 12. The third solenoid valve 23 is connected on its input side to the third CNG cascade bank 13. The output sides of the first, second and third solenoid valves 21, 22 and 23 are connected in parallel to the gas dispenser output 15. The three solenoid valves are connected to the fill controller 20 by electrical circuit 38. A temperature probe 33 in the receptacle cylinder 18 is connected to the fill controller 20 by electrical circuit 37. A pressure monitor 32 in the dispenser 14 is connected to the fill controller by electrical circuit 36. A flow meter 31 in the dispenser 14 is connected to the fill controller by electrical circuit 35.

Figure 2A:
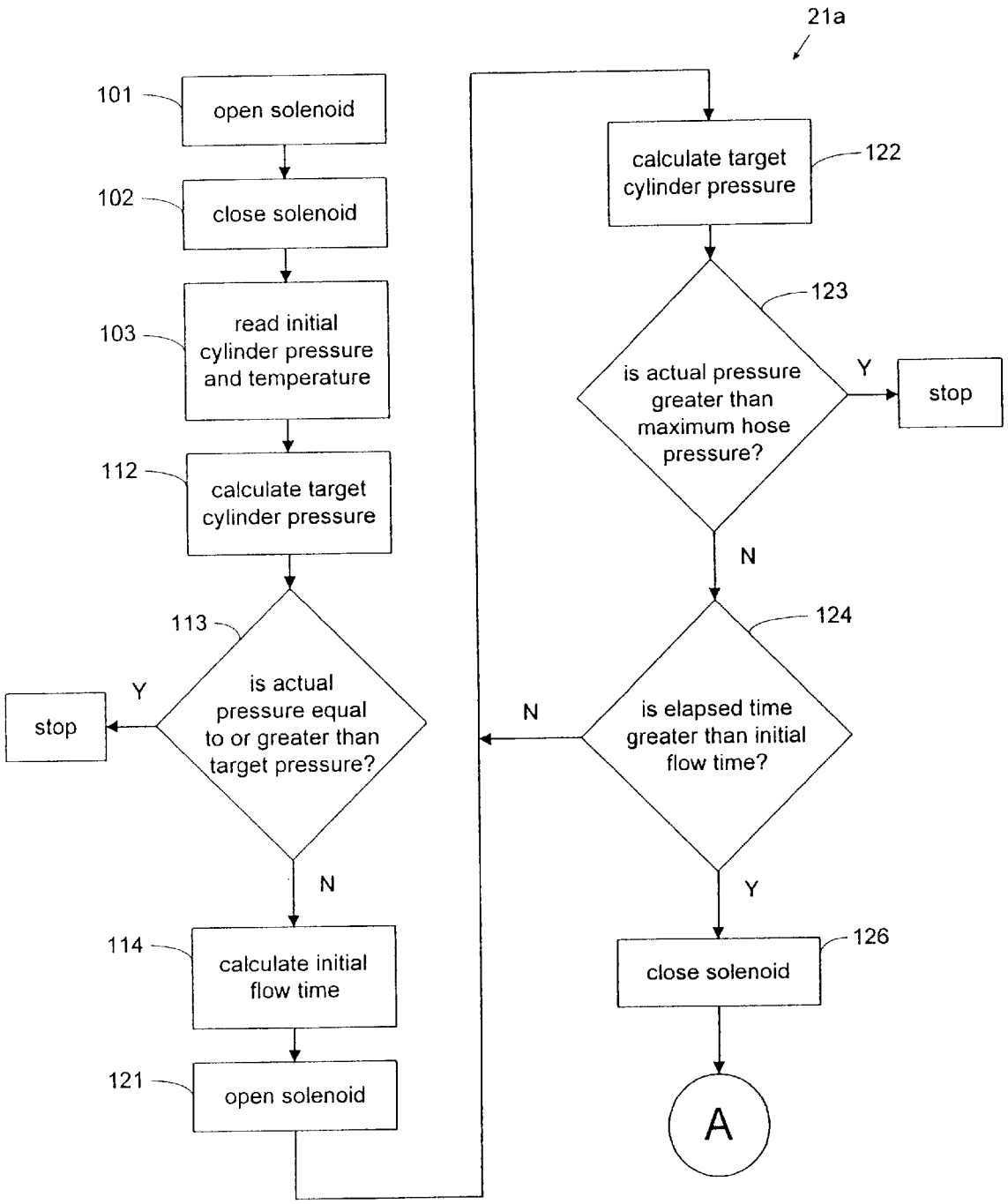
FIGS. 2A–2C are simplified flow charts of the control software of FIG. 1.
Figure 2B:
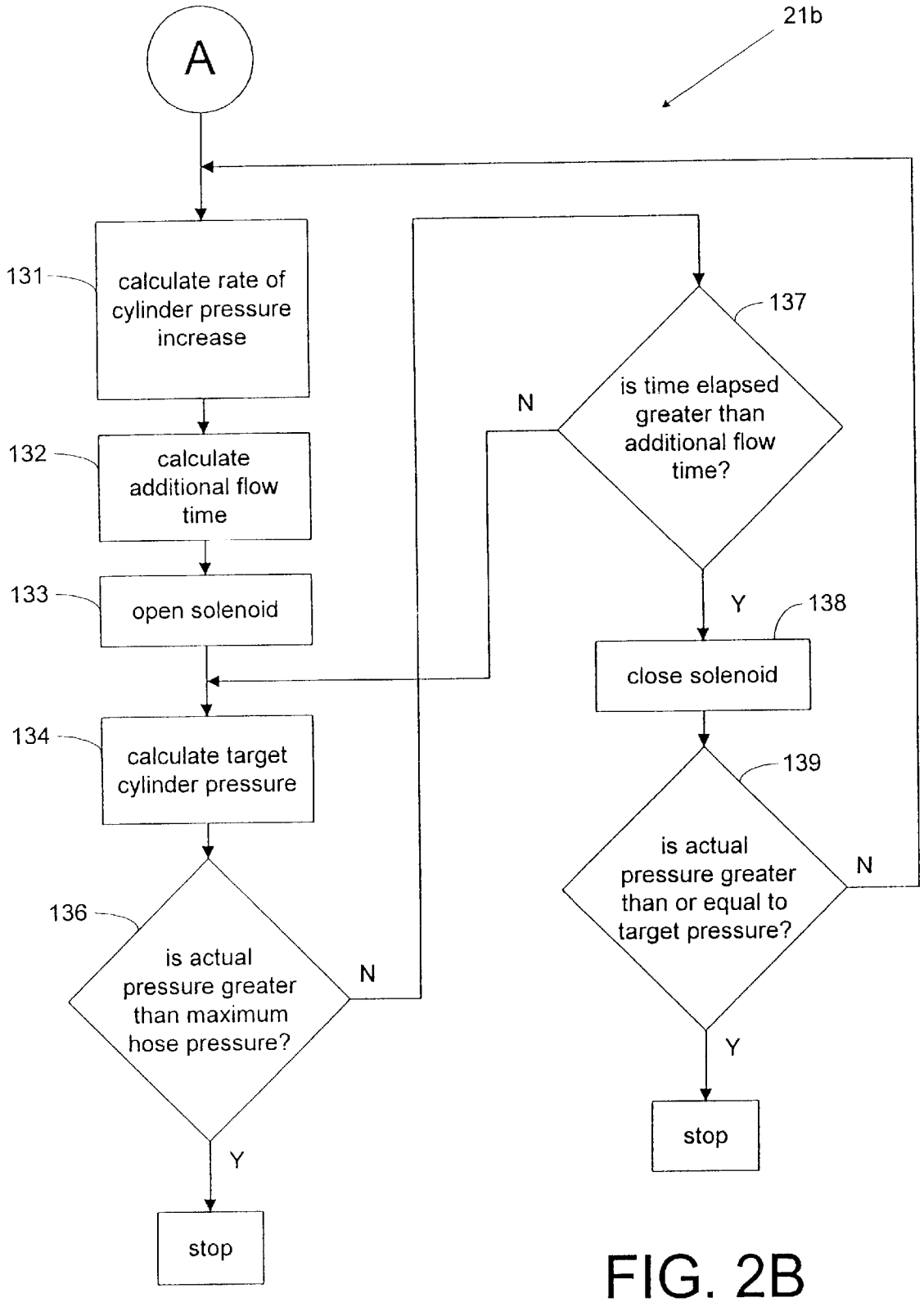
Figure 2C:
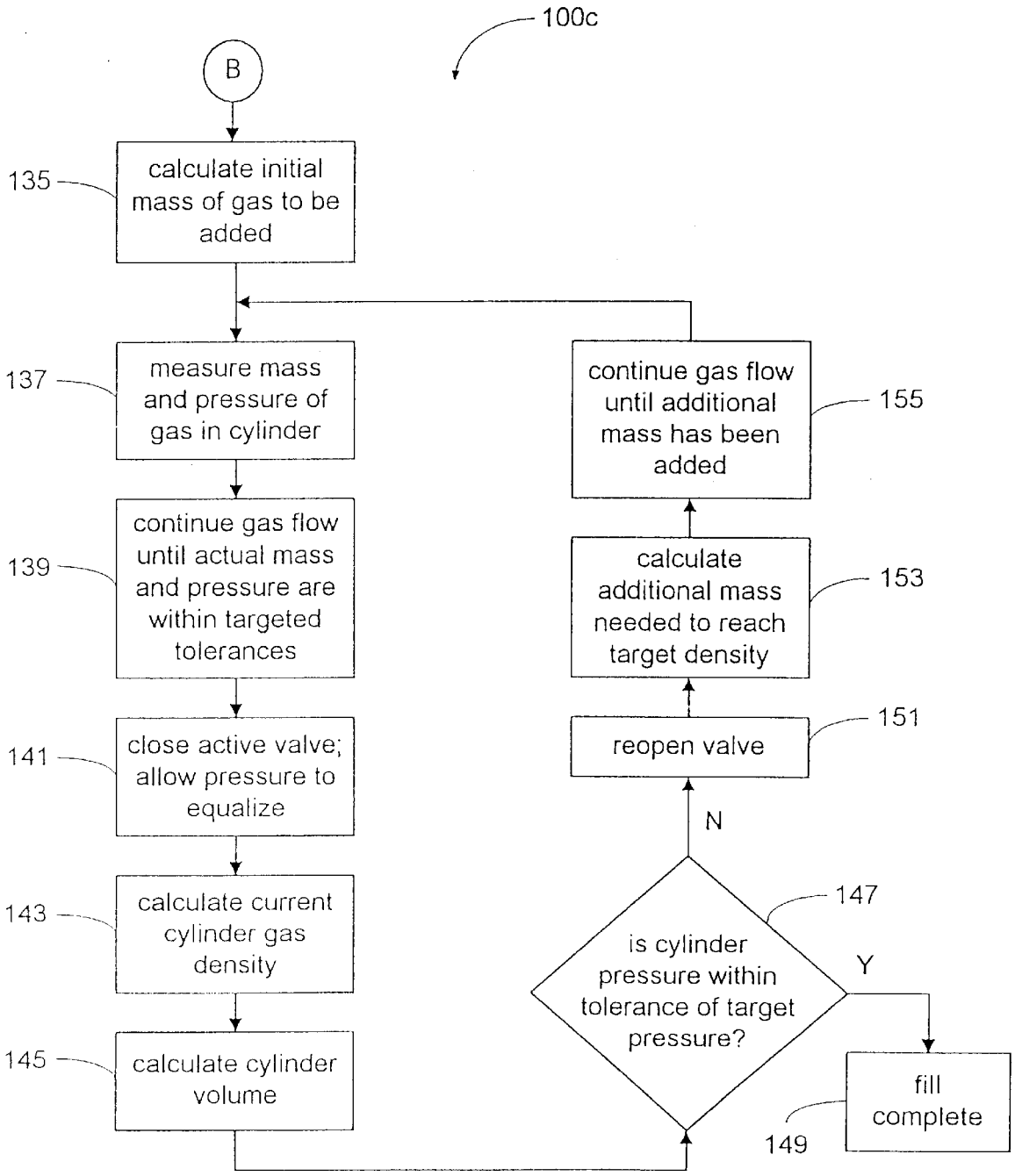

FIGS. 2A–2C are a simplified flow chart of the control software for the fill controller 20, generally denoted by reference numeral 100. Taken together, FIGS. 1 and 2A–2C illustrate the sequential steps of the fill control system and method. FIG. 2A illustrates the initial program steps (generally denoted by reference numeral 100*a*) as follows: the fill process begins with step 101 in which the fill controller 20 detects that a cylinder has been attached to the dispenser. Next, in step 103 the fill controller initiates the fill process by opening the first solenoid valve 21, and then closing the first solenoid valve 21 less than one second later. When the first solenoid valve is opened, the check valve 17 in the cylinder also opens, thus allowing the gas pressure in the dispenser 14 and cylinder 18 to equalize. The fill controller allows the first solenoid valve to stay open for less than one second in order to allow the gas pressure to equalize, and then closes the first solenoid valve 21. Once the first solenoid valve is closed and the pressure between the dispenser and cylinder has equalized, the fill controller determines the initial pressure and temperature in the cylinder 18 by means of the pressure monitor 32 at the dispenser and the temperature probe 33 in the cylinder.

Based upon the in-cylinder gas temperature, the in-cylinder gas pressure (measured at the dispenser), and the gas composition (from the dispenser setup file), the fill controller in step 105 calculates the initial gas density in the cylinder using the calculation method given in American Gas Association (AGA) Report No. 8. In step 107, the fill controller calculates an initial cylinder target pressure ($P_{target}$) according to the following equation (Eq. 1):

$$P_{target}=P_{rated}+M(T_{cylinder}-T_{rated})$$

where $P_{rated}$ is the rated cylinder pressure (typically 3,000 psig or 3,600 psig), $T_{rated}$ is the rated cylinder temperature (typically 70° F.), and $T_{cylinder}$ is the current in-cylinder gas temperature. The constant "M" is the slope of the constant density curve which passes through the point at the rated cylinder pressure and temperature for the current gas composition (from the dispenser setup file).

After the initial target pressure is calculated, in step 109 the fill controller monitors the system for compliance with safety features that have been programmed by the user, which can include verifying that the receptacle cylinder is not already full and verifying that the pressure does not exceed the rated pressure for the connecting hose 16. If the safety conditions are not met, the fill controller stops the fill process. If the safety conditions are met, the fill process continues to step 111 in which the fill controller opens the flow control valve for the first cascade bank 21 to initiate the fill by allowing gas to flow from the first cascade bank 11 into the cylinder 18.

As the gas flows into the cylinder, the pressure and temperature in the cylinder changes. The cylinder data is constantly monitored by the fill controller via a subroutine, which runs constantly at a rate of approximately 5 cycles/second during the fill process. This subroutine (which is generally denoted in FIG. 2B by reference numeral 100*b*) operates as follows: first, the fill controller reads the new cylinder pressure and temperature data in step 113. In step 115 the fill controller uses the new cylinder pressure and temperature data to calculate a new target pressure using Eq. 1. Next, in step 117 the fill controller calculates a target density for the cylinder using the calculation method given in AGA Report No. 8. This target density is the lesser of (a) the in-cylinder gas density at the rated cylinder temperature and pressure (typically 3,000 psig and 70° F.), or (b) the in-cylinder gas density at the current in-cylinder gas temperature and the maximum cylinder pressure (which is typically slightly less than 125% of the rated cylinder pressure).

In step 119 the fill controller reads new data from the dispenser and in step 121 the safety conditions are again checked as in step 109. During the repetition of subroutine 100*b*, if the fill controller ever determines in step 121 that the safety conditions are not met, the fill is terminated by shutting all flow valves, which stops the flow of gas into the cylinder. If the safety conditions are met, the flow of gas into the cylinder continues (step 123). In step 125 the fill controller determines the mass of gas that has been added to the cylinder. In step 127 the fill controller calculates the flow rate of the gas. All pertinent data is then written to a data file in step 129.

Next, in step 131 the fill controller compares the peak flow rate for the current cascade bank with the current flow rate. If the current flow rate has fallen below an operator defined value (typically 10% to 20% of the maximum flow rate for the current cascade bank) the fill controller closes the flow valve for the current cascade bank and switches to the next cascade bank by opening the flow control valve for that bank; otherwise the gas flow continues from the current cascade bank. In step 133 the fill controller determines the peak flow rate for the cascade bank that is active after step 131.

After completing step 133, subroutine 100*b* returns to step 113. Steps 113–133 are continuously repeated during the fill process.

Simultaneously with the running of subroutine 100*b*, the main program continues. The continuation of the main program is generally denoted in FIG. 2C by reference number 100*c*, and operates as follows: after the flow valve is opened in step 111, the main program proceeds to step 135 in which the fill controller calculates an initial mass ($M_{initial}$) to be added to the cylinder according to the following equation (Eq. 2):

$$M_{initial}=V_{min}(\rho_{target}-\rho_{initial})$$

where $\rho_{target}$ is the target density and $\rho_{initial}$ is the initial in-cylinder gas density calculated in step 105. $V_{min}$ is a minimum cylinder volume for the receptacle cylinder that is programmed into the fill controller. For public CNG refueling $V_{min}$ would be the volume of the smallest cylinder manufactured; for fleet refueling, this volume would be the volume of the smallest cylinder in the fleet.

The fill controller in step 137 continuously compares the actual mass and pressure of the gas added to the cylinder with the calculated initial mass and the target pressure. Step 139 allows the gas flow to continue until the initial mass ($M_{nitial}$) has been added to the cylinder and the cylinder pressure is within some user defined tolerance of the target pressure, typically 300 psig. Once this state is reached, the fill controller in step 141 stops the flow of gas into the cylinder by closing the valve for the active cascade bank (21, 22 or 23) and allows the cylinder pressure and dispenser pressure to equalize.

Once the pressure has equalized, the fill controller in step 143 calculates the in-cylinder gas density using the calculation method given in AGA Report No. 8. Next, the fill controller in step 145 calculates the cylinder volume ($V_{cylinder}$) using the following equation (Eq. 3):

$$V_{cylinder}=M_{added}+(\rho_{intermediate}-\rho_{initial})$$

where $M_{added}$ is the mass that has been dispensed into the receptacle cylinder, $\rho_{initial}$ is the initial in-cylinder gas density, and $\rho_{intermediate}$ is the in-cylinder gas density calculated in step 143 after pressure equalization between the dispenser and cylinder. Next, in step 147 the fill controller compares the cylinder pressure to the target pressure. If the cylinder pressure is within some user defined tolerance of the target pressure (which tolerance can be set by the operator and is typically 50 psig), then the fill is complete and the fill controller ends the fill in step 149.

If the cylinder pressure is not within the user defined tolerance of the target pressure after step 147, the program proceeds to step 151 in which the fill controller reopens the current flow control valve . In step 153 the fill controller calculates an additional mass ($M_{additional}$) to be added to the receptacle cylinder in order to reach the target density using the following equation (Eq. 4):

$$M_{additional}=V_{cylinder}(\rho_{target}-\rho_{intermediate})$$

Since the target density may be changing during the fill due to the changing cylinder temperature, this additional mass is continuously recalculated. The fill controller in step 155 continuously monitors the fill and determines when the additional mass ($M_{additional}$) has been added.

Once the additional mass has been added to the cylinder, the fill controller goes back to step 137 and repeats the measurement process of steps 137–147. If the cylinder pressure is within 50 psig of the target pressure after step 147 has been repeated, the fill controller goes to step 149 and terminates the fill by closing the flow valve for the active cascade bank. If the cylinder pressure is not within 50 psig of the target pressure after step 147 has been repeated, the fill controller reopens the flow valve for the active cascade bank (step 151), calculates a second additional mass to be added to reach the target density (step 153) and continuously monitors the fill to determine when the second additional mass has been added (step 155). Once the second additional mass has been added, the fill controller again recycles through steps 137–147. The fill controller repeats this process and adds more incremental masses of gas to the cylinder until step 147 determines that the cylinder pressure is within 50 psig of the target pressure, whereupon the fill controller cycles to step 149 and terminates the fill by closing the flow valve for the active cascade bank.

Many variations and modifications may be made to the preferred embodiment of the invention, as described previously, without substantially departing from the spirit and scope of the present invention. As an example, the fill controller may be programmed to stop the fill process after expiration of some specific period of time or after a specified number of cycles, even if the target cylinder pressure has not been attained.

Furthermore, in the claims hereafter, the structures, materials, acts, and equivalents of all "means" elements, "logic" elements, and steps are intended to include any structures, materials, or acts for performing the functions specified in connection with said elements.

Now, therefore, the following is claimed:

1. A system for accurately filling a cylinder with a gas, comprising:

a means for measuring the gas pressure in said cylinder and producing a signal corresponding to said pressure;

a means for measuring the gas temperature in said cylinder and producing a signal corresponding to said temperature;

a means for calculating the volume of said cylinder;

a plurality of valves connected in parallel, each of said plurality of valves being connected on one side to one of a plurality of gas dispensers and on the other side to said cylinder; and a fill controller programmed to open and close said plurality of valves as a function of said pressure and temperature signals and the volume of said cylinder, thereby controlling the flow of said gas into said cylinder.

2. The system of claim 1 in which said plurality of valves are solenoid valves.

3. The system of claim 1 in which said means for measuring said gas pressure is a pressure monitor.

4. The system of claim 1 in which said means for measuring said gas temperature is a temperature probe.

5. The system of claim 1 in which said fill controller is programmed to close said plurality of valves if said pressure signal equals or exceeds the maximum allowable pressure rating of any component connected to said system.

6. The system of claim 1 in which said fill controller is programmed to calculate the mass of gas to be added to said cylinder as a function of said pressure and temperature signals and the volume of said cylinder and to open and close said plurality of valves in accordance with said calculated mass of gas.

7. The system of claim 6 which said fill controller is programmed to calculate such additional masses of gas to be added to said cylinder as are necessary to fill the cylinder to a calculated target pressure and to open and close said plurality of valves in accordance with said calculated additional masses of gas.

* * * * *